US008397907B1

(12) United States Patent
Miele, Sr. et al.

(10) Patent No.: US 8,397,907 B1
(45) Date of Patent: Mar. 19, 2013

(54) TOILET PAPER HOLDING DEVICE

(76) Inventors: Robert E. Miele, Sr., Bronx, NY (US); Judy A. Calandrino, Hawthorne, NY (US)

( * ) Notice: Subject to any disclaimer, the term of this patent is extended or adjusted under 35 U.S.C. 154(b) by 0 days.

(21) Appl. No.: 13/448,494

(22) Filed: Apr. 17, 2012

Related U.S. Application Data

(60) Provisional application No. 61/517,471, filed on Apr. 20, 2011.

(51) Int. Cl.
*B65D 85/672* (2006.01)

(52) U.S. Cl. ..... 206/225; 206/394; 206/457

(58) Field of Classification Search ..... 206/225, 206/391, 394, 457; 312/42, 45
See application file for complete search history.

(56) References Cited

U.S. PATENT DOCUMENTS 2,534,290 A 12/1950 Moskowitz
3,275,133 A 9/1966 Wood
4,192,561 A 3/1980 Gunn
4,369,929 A * 1/1983 Cayer ..... 242/423.1
4,432,451 A * 2/1984 Hooser ..... 206/216
4,998,619 A * 3/1991 Sowa et al. ..... 206/392
5,344,014 A * 9/1994 Toral et al. ..... 206/394
6,109,429 A * 8/2000 Cunningham et al. ..... 206/15.2
6,193,059 B1 * 2/2001 Massaro ..... 206/225
6,439,383 B1 * 8/2002 Janousek ..... 206/394
6,854,596 B1 * 2/2005 Wiese ..... 206/225

* cited by examiner

*Primary Examiner* — Jacob K Ackun
(74) *Attorney, Agent, or Firm* — Emery L. Tracy

(57) ABSTRACT

A toilet paper holding device for holding a spare roll of toilet paper or tissue is provided. The toilet paper holding device comprises a base plate and a top plate. A plurality of panels and a plurality of rods are mounted between the base plate and the top plate. The spare roll of toilet paper is visible between the panels and the rods. The lid sits on top of the toilet paper roll when inserted. When the holder is empty, the lid rests on the bottom of the device to serve as a reminder that the receptacle needs to be refilled.

6 Claims, 5 Drawing Sheets

TOILET PAPER HOLDING DEVICE

The present application claims the benefit of priority of provisional patent application Ser. No. 61/517,471, filed on Apr. 20, 2011, entitled "Toilet Paper Holder".

BACKGROUND OF THE INVENTION

1. Field of the Invention

This invention relates generally to a toilet paper holding device and, more particularly, the invention relates to a toilet paper holding device providing an artistically rendered housing for a spare roll of toilet tissue that also lends stylish flair to a bathroom.

2. Description of the Prior Art

Perhaps the most important and useful room in any home is the bathroom. The bathroom is the one room where people shower or bathe, brush their teeth, shave, apply makeup, and undergo other personal grooming tasks. Providing a quiet space in which a person can have a few moments to themselves, many people find that time spent in the bathroom is actually the only time during a hectic day when they are completely alone. Used by family members and guests alike, bathrooms are high traffic areas that are repeatedly accessed throughout the day and night. Because people spend so much time in their bathrooms, most people take care to decorate this room as they would any other room in their home. Whether by hanging crisp curtains and pretty wallpaper, matching hand and bath towels, or simply by placing a few scented candles on the countertop, creating a homey atmosphere can make time spent in the bathroom enjoyable and relaxing.

SUMMARY

The present invention is a toilet paper holding device for holding a spare roll of toilet paper or tissue. The toilet paper holding device comprises a base plate and a top plate. A plurality of panels and a plurality of rods are mounted between the base plate and the top plate. The spare roll of toilet paper is visible between the panels and the rods.

In addition, the present invention is a toilet paper holding device for holding a spare roll of toilet paper or tissue. The toilet paper holding device comprises a base plate and a top plate with the top plate having an opening sized and shaped for receiving the roll of toilet paper. A plurality of panels and a plurality of rods are mounted between the base plate and the top plate. A lid rests within the annular opening of the top plate and upon the toilet paper roll. The shape of the base plate and the top plate are selected from the group consisting of round, hexagon, and octagon. The toilet paper roll rests upon the base plate when positioned within the toilet paper holding device and is visible between the panels and the rods. Upon the toilet paper roll being removed, the lid is restable on the base plate.

The present invention further includes a method for holding a spare roll of toilet paper or tissue. The method comprises providing a base plate, providing a top plate having an opening sized and shaped for receiving the roll of toilet paper, positioning a plurality of panels between the base plate and the top plate, positioning a plurality of rods between the base plate and the top plate, resting a lid within the annular opening of the top plate and upon the toilet paper roll, selecting the shape of the base plate and the top plate from the group consisting of round, hexagon, and octagon, resting the toilet paper roll upon the base plate, visibly viewing the toilet paper between the panels and the rods, removing the toilet paper roll, and resting the lid on the base plate.

DETAILED DESCRIPTION OF THE PREFERRED EMBODIMENTS

Figure 1:
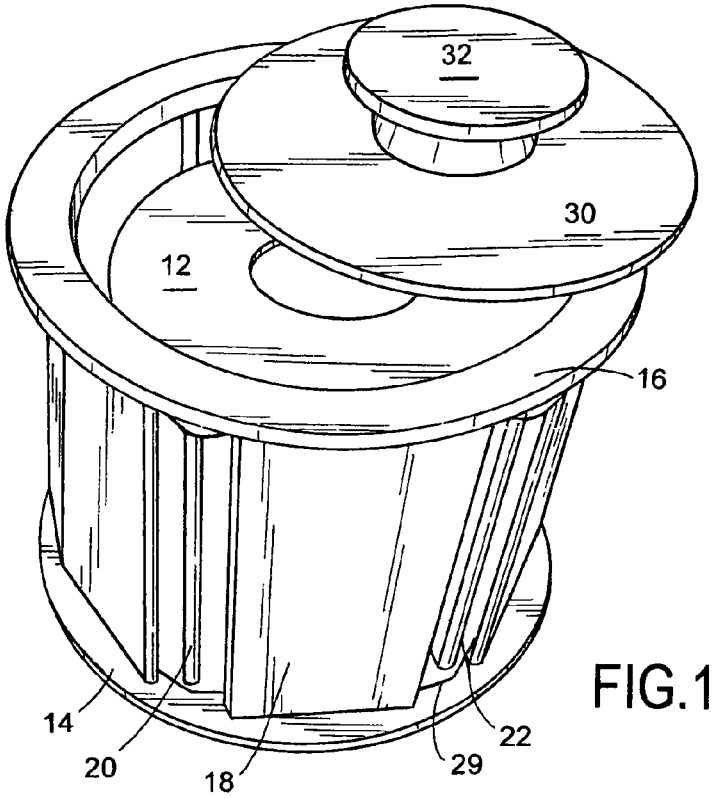
FIG. 1 is a perspective view illustrating a toilet paper holding device, constructed in accordance with the present invention, with a toilet paper roll seated in the holding device.
Figure 2:
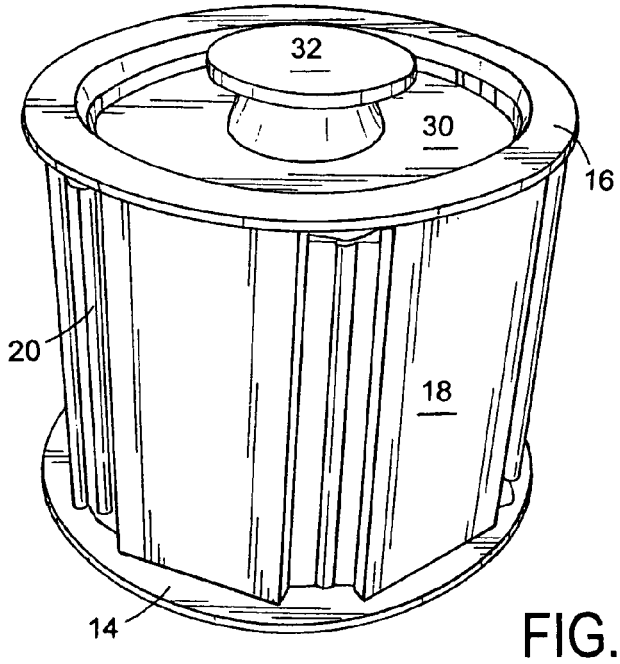
FIG. 2 is a perspective view illustrating the toilet paper holding device of FIG. 1, constructed in accordance with the present invention, with the toilet paper roll seated in the holding device, a lid positioned on top of the toilet paper roll, and the toilet paper roll visible through the toilet paper holding device.
Figure 3:
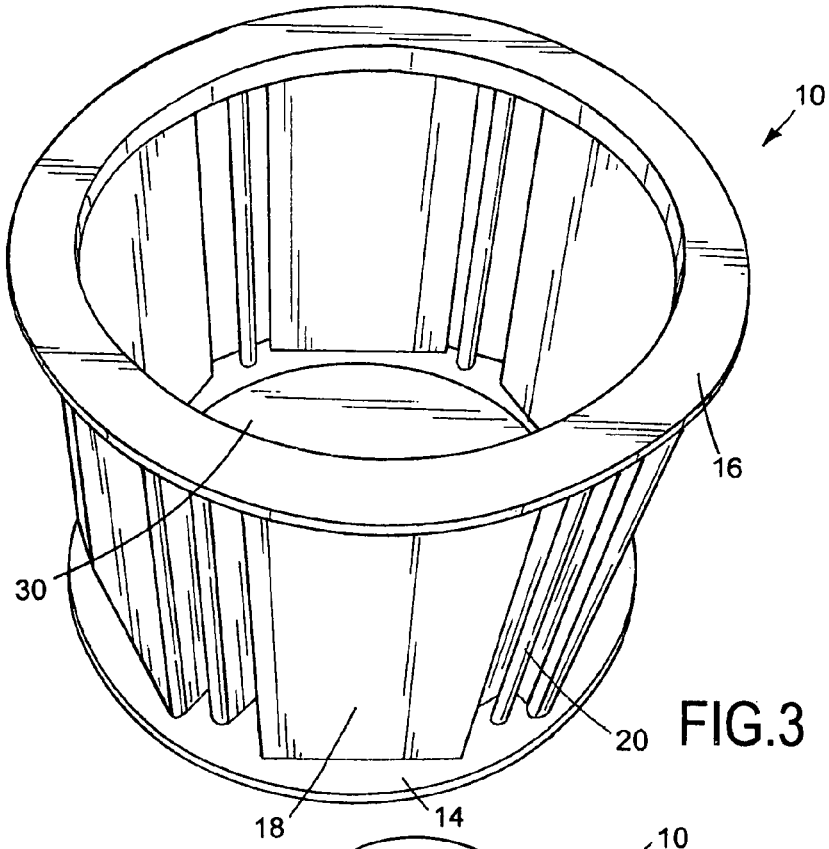
FIG. 3 is a perspective view illustrating the toilet paper holding device of FIG. 1, constructed in accordance with the present invention, with the holding device being empty and the lid completely positioned within the holding device.
Figure 4:
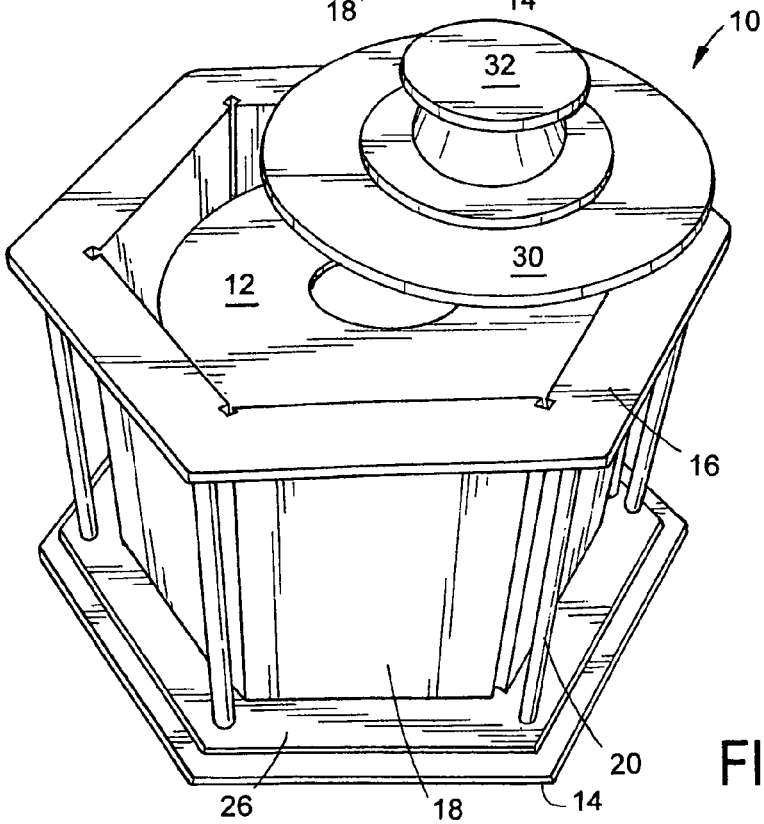
FIG. 4 is a perspective view illustrating another embodiment of the toilet paper holding device, constructed in accordance with the present invention, with the toilet paper roll seated in the holding device.
Figure 5:
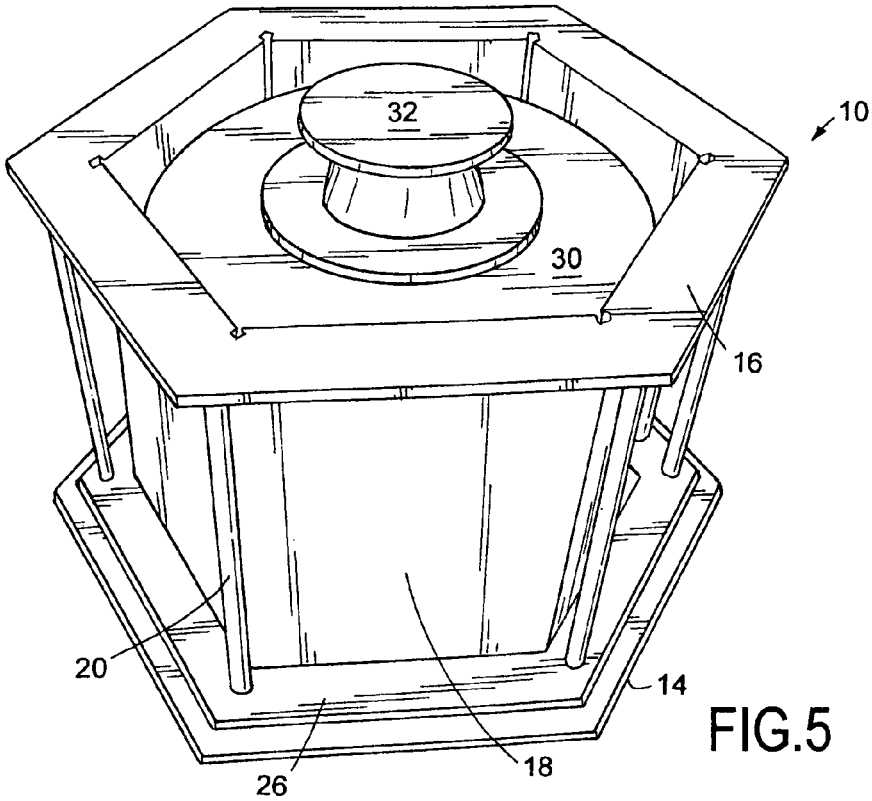
FIG. 5 is a perspective view illustrating the toilet paper holding device of FIG. 4, constructed in accordance with the present invention, with the toilet paper roll seated in the holding device, the lid positioned on top of the toilet paper roll, and the toilet paper roll visible through the toilet paper holding device.
Figure 6:
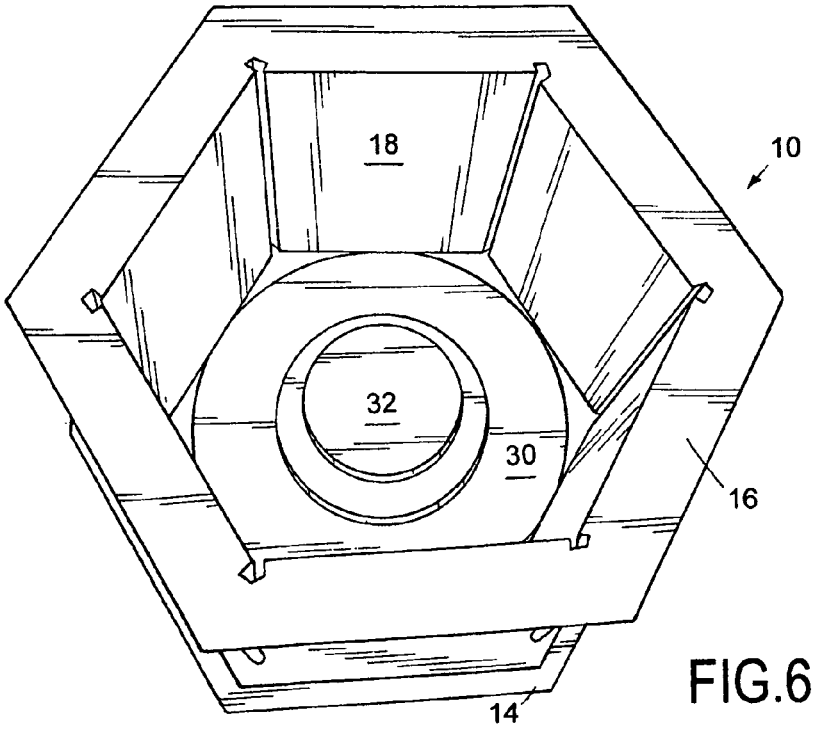
FIG. 6 is a perspective view illustrating the toilet paper holding device of FIG. 4, constructed in accordance with the present invention, with the holding device being empty and the lid completely positioned within the holding device.
Figure 7:
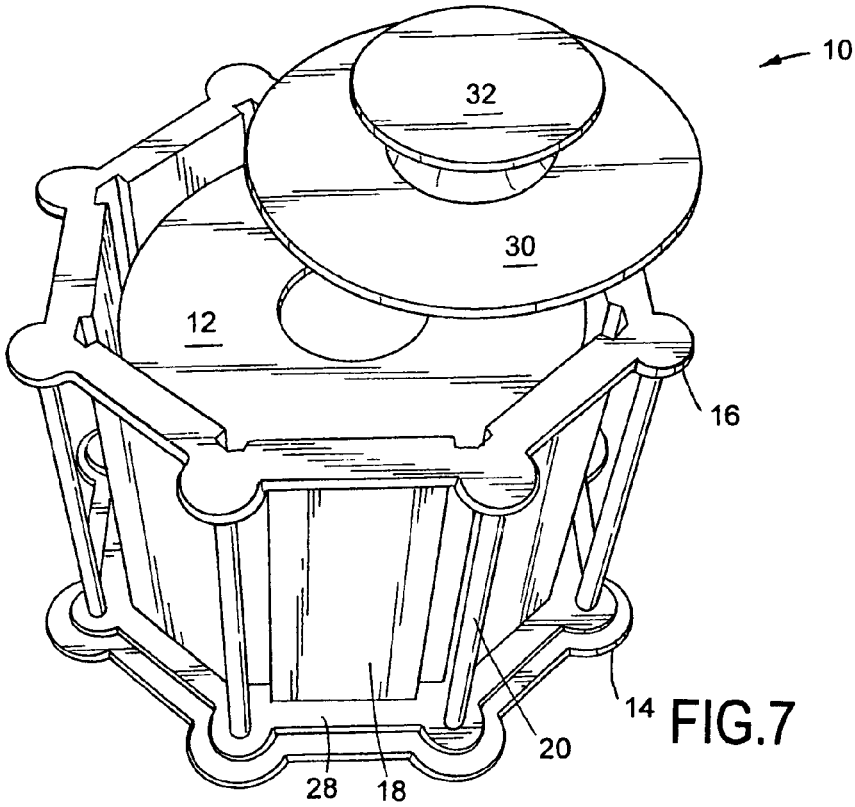
FIG. 7 is a perspective view illustrating still another embodiment of the toilet paper holding device, constructed in accordance with the present invention, with the toilet paper roll seated in the holding device.
Figure 8:
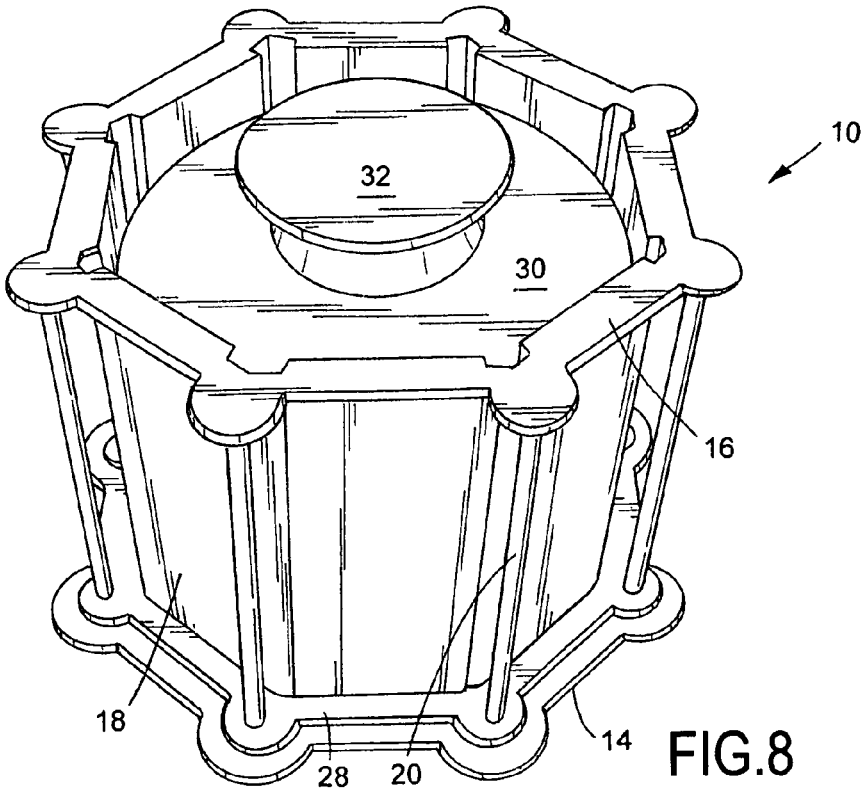
FIG. 8 is a perspective view illustrating the toilet paper holding device of FIG. 7, constructed in accordance with the present invention, with the toilet paper roll seated in the holding device, the lid positioned on top of the toilet paper roll, and the toilet paper roll visible through the toilet paper holding device.
Figure 9:
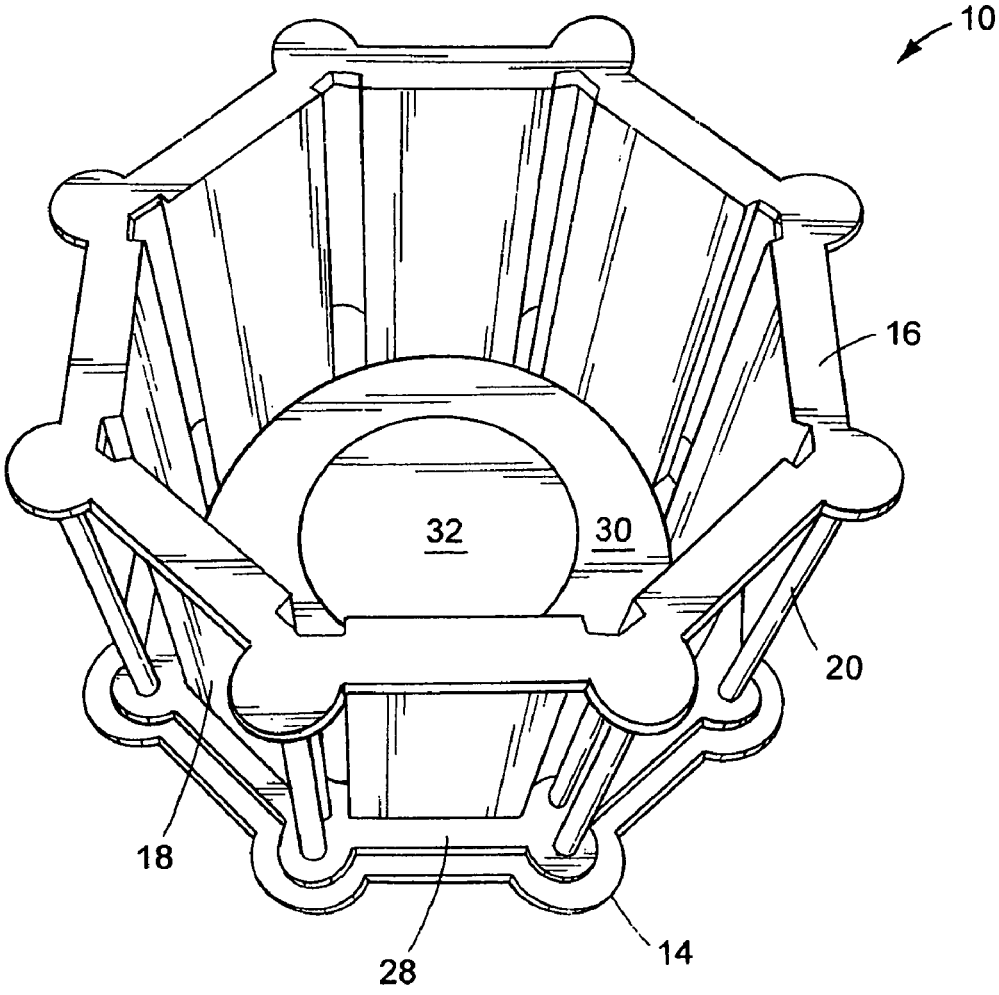
FIG. 9 is a perspective view illustrating the toilet paper holding device of FIG. 7, constructed in accordance with the present invention, with the holding device being empty and the lid completely positioned within the holding device.

As illustrated in FIGS. 1-9, the present invention is a toilet paper holding device, indicated generally at 10, providing an artistically rendered housing for a spare roll of toilet paper or tissue 12 that also lends stylish flair to a bathroom. The toilet paper holding device 10 of the present invention turns an ordinary toilet tissue housing unit into a functional, decorative showpiece.

The toilet paper holding device 10 of the present invention includes a planar base plate 14 and an annular top plate 16 spaced from the base plate 14. Separating the base plate 14 from the top plate 16 is a plurality of panels 18 and rods 20 alternatingly positioned adjacent an outer edge of the base plate 14 and the top plate 16. Preferably, a gap or other opening 22 is present between the panels 18 and rods 20 allowing a user to view whether a toilet paper roll 12 is within the toilet paper holding device 10.

The shape of the base plate 14 and the top plate 16 of the toilet paper holding device 10 of the present invention can be selected from the group consisting of round, hexagon, and octagon. Preferably, the base plate 14 and the top plate 16 have the same shape with their outer edges aligned with each other. The shape of the base plate 14 and the top plate 16 are a user's choice and all configurations of the toilet paper holding device 10 allow a user to visually inspect the contents of the toilet paper holding device 10 to determine whether it is empty or not. It should be noted that while a particular shape of the base plate 14 and the top plate 16 have been designated and depicted herein, it is within the scope of the present invention for the bottom plate 14 and the top plate 16 to have other shapes.

The round configuration of the toilet paper holding device 10 of the present invention preferably has six panels 18 and six rods 20. The rods 20 are preferably set into a hexagon frame 24 mounted on the base plate 14 and top plate 16 with the panels 18 mounted outside the frame 24. In this embodiment, the panels 18 and rods 20 are substantially aligned adjacent an outer edge of the base plate 14 and the top plate 16.

The hexagon configuration of the toilet paper holding device 10 of the present invention also preferably has six panels 18 and six rods 20. The rods 20 are preferably set into a frame 26 mounted on the base plate 14 and attach to the top plate 16 with the panels 18 mounted within the frame 26. In this embodiment, the rods 20 are mounted adjacent an outer edge of the base plate 14 and the top plate 16 with the panels 18 inset from the rods 20 and gaps between the panels 18 aligned with the rods 20.

The octagon configuration of the toilet paper holding device 10 of the present invention preferably has eight panels 18 and eight rods 20. Like the hexagon embodiment, the rods 20 are preferably set into a frame 28 mounted on the base plate 14 and attach to the top plate 16 with the panels 18 mounted within the frame 28. In this embodiment, the rods 20 are mounted adjacent an outer edge of the base plate 14 and the top plate 16 with the panels 18 inset from the rods 20 and gaps between the panels 18 aligned with the rods 20.

The top plate 16 of the toilet paper holding device 10 of the present invention has an opening sized and shaped for receiving the roll of toilet paper 12 such that the toilet paper roll 12 rests upon the base plate 14 when positioned within the toilet paper holding device. A lid 30 with a decorative knob 32 rests within the annular opening of the top plate 16 and upon the toilet paper roll 12. When empty, the lid 30 rests upon the base plate 14 thereby providing an obvious visual determination that the toilet paper holding device 10 is empty.

The toilet paper holding device 10 of the present invention has dimensions of approximately five (5") inches in height and four and three-quarters (4¾") inches inside width. Preferably constructed of an attractive yet durable, 3-ply birch wood material, the framework of the toilet paper holding device 10 has an open-area adorned with a series of ornate rods surrounding the perimeter of the base plate 14 and the top plate 16. The toilet paper holding device 10 can be made available in a wide variety of color combinations to appeal to individual tastes, or to match an existing decorative motif. Thus constructed, the toilet paper holding device 10 can be ready for use in a matter of seconds. Placing the toilet paper holding device 10 in an easily accessible area, such as on top of the toilet tank, a user simply inserts a full roll of toilet tissue 12 into the toilet paper holding device 10 and places the lid 30 on top of the toilet paper roll 12. Should one find that he or she is out of toilet paper 12, they need only access the toilet paper holding device 10. When empty, the lid 30 of the toilet paper holding device 10 rests on the base plate 14 serving as a handy reminder that the toilet paper holding device 10 needs to be refilled.

The toilet paper holding device 10 of the present invention can be made available in a wide variety of color combinations to appeal to individual tastes, or to match an existing decorative motif. Additional design considerations may include, but are not limited to, an Adirondack country scene, oceanic scene, and even children's characters. Also, the toilet paper holding device 10 can be fabricated of plastic or chrome for a more contemporary look and feel. In addition to the shapes described and illustrated herein, other shaped toilet paper holding devices 10 can be produced to offer variety to the user.

There are many significant benefits and advantages associated with the toilet paper holding device 10 of the present invention. Foremost, the toilet paper holding device 10 offers users an attractive, decorative showpiece for use in any bathroom. Featuring a classical, ornate design, the toilet paper holding device 10 provides users a unique and stylish accent for the home. For the countless users who enjoy decorating their bathrooms, the toilet paper holding device 10 provides a dazzling focal point to their existing decor. Not only attractive, the toilet paper holding device 10 provides users quick and easy access to an extra roll of toilet tissue, eliminating embarrassing and ungraceful searches through cabinets and utility closets. When the toilet paper holding device 10 is empty, the lid 30 rests on the bottom of the device serving as a reminder that it needs to be refilled. Although designed with the home user in mind, the toilet paper holding device proves a charming addition to any public rest room, particularly those found in restaurants and hotel rooms.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A toilet paper holding device for holding a spare roll of toilet paper or tissue, the toilet paper holding device comprising:

a base plate;

a top plate having an opening sized and shaped for receiving the roll of toilet paper;

a plurality of panels between the base plate and the top plate;

a plurality of rods between the base plate and the top plate;

a lid resting within an annular opening of the top plate and upon the toilet paper roll;

wherein the shape of the base plate and the top plate are selected from the group consisting of round, hexagon, and octagon;

wherein the toilet paper roll rests upon the base plate when positioned within the toilet paper holding device and is visible between the panels and the rods; and wherein upon the toilet paper roll being removed, the lid is restable on the base plate.

2. The toilet paper holding device of claim 1 wherein the panels and rods are alternatingly positioned adjacent an outer edge of the base plate and the top plate.

3. The toilet paper holding device of claim 2 wherein at least one rod is positioned between adjacent panels.

4. The toilet paper holding device of claim 3 and further comprising:

a gap between adjacent panels and rods.

5. The toilet paper holding device of claim 1 wherein the base plate and the top plate have the same shape with outer edges aligned with each other.

6. A method for holding a spare roll of toilet paper or tissue, the method comprising:

providing a base plate;

providing a top plate having an opening sized and shaped for receiving the roll of toilet paper;

positioning a plurality of panels between the base plate and the top plate;

positioning a plurality of rods between the base plate and the top plate;

resting a lid within the annular opening of the top plate and upon the toilet paper roll;

selecting the shape of the base plate and the top plate from the group consisting of round, hexagon, and octagon;

resting the toilet paper roll upon the base plate;

visibly viewing the toilet paper between the panels and the rods;

removing the toilet paper roll; and resting the lid on the base plate to show that the receptacle needs to be refilled.

* * * * *